US012441440B2

(12) United States Patent
Thimmesch-Slepica

(10) Patent No.: US 12,441,440 B2
(45) Date of Patent: Oct. 14, 2025

(54) BOAT ANCHOR STORAGE APPARATUS

(71) Applicant: Slepica Studio LLC, Highland, MI (US)

(72) Inventor: Jacob James Thimmesch-Slepica, Highland, MI (US)

(73) Assignee: Slepica Studio, LLC, Highland, MI (US)

( * ) Notice: Subject to any disclaimer, the term of this patent is extended or adjusted under 35 U.S.C. 154(b) by 510 days.

(21) Appl. No.: 17/955,945

(22) Filed: Sep. 29, 2022

(65) Prior Publication Data

US 2023/0110321 A1 Apr. 13, 2023

Related U.S. Application Data

(60) Provisional application No. 63/253,194, filed on Oct. 7, 2021.

(51) Int. Cl.
*B63B 21/22* (2006.01)

(52) U.S. Cl.
CPC ..... *B63B 21/227* (2013.01)

(58) Field of Classification Search
CPC ..... B63B 21/00; B63B 21/22; B63B 21/227; B63B 21/24
USPC ..... 114/293, 294, 343, 364, 392
See application file for complete search history.

(56) References Cited

U.S. PATENT DOCUMENTS 3,977,448 A 8/1976 Botting
4,834,015 A * 5/1989 Alpert ..... B63B 21/29 114/294
4,974,537 A * 12/1990 Martin ..... B63B 35/14 224/406
5,081,947 A * 1/1992 Holden ..... B63B 7/08 114/352
5,878,688 A 3/1999 Merrett et al.
5,967,077 A 10/1999 Shapiro
5,975,002 A * 11/1999 Rieger ..... B63B 25/002 114/343
6,101,966 A * 8/2000 Cumisky ..... A01K 97/06 114/364
7,101,234 B2 * 9/2006 Clouse ..... B63B 17/00 440/7

(Continued)

FOREIGN PATENT DOCUMENTS

KR 20090012544 12/2009
KR 20190033794 4/2019
WO 2004/031031 4/2004

OTHER PUBLICATIONS

The Ocean Sailing Guide, Boat Anchor Winch Guide—Find The Best Winch for Your Boat (Apr. 2021).

*Primary Examiner* — Daniel V Venne
(74) *Attorney, Agent, or Firm* — Harness, Dickey & Pierce, PLC

(57) ABSTRACT

A boat anchor storage tray includes an attachment member, and at least one mounting channel attached to the attachment member. In another aspect, a tray is slidably engaged with the at least one mounting channel and is configured to move between an open position and a closed position below a boat deck. A further aspect of a movable boat anchor storage tray includes water draining holes. In yet another aspect, a boat apparatus includes a storage tray moveable from an open position to a closed position below a pontoon boat deck, with a lock movably securing the tray in the closed position.

22 Claims, 21 Drawing Sheets

(56) References Cited

U.S. PATENT DOCUMENTS

| | | | | |
|---|---|---|---|---|
| 7,475,648 | B2 * | 1/2009 | Funayose ..... | B63B 11/00<br>114/55.53 |
| 2014/0041569 | A1 | 2/2014 | Couch, III et al. | |

* cited by examiner

BOAT ANCHOR STORAGE APPARATUS

CROSS-REFERENCE TO RELATED APPLICATION

The application claims the benefit of U.S. Provisional Patent Application Ser. No. 63/253,194, filed on Oct. 7, 2021, which is incorporated by reference herein.

FIELD

The present disclosure generally relates to a storage tray for use on a boat and more particularly to a boat anchor storage tray.

BACKGROUND

It has long been desired in the boating industry to provide a storage area for a boat anchor. Most boat anchor storage areas, however, are located on the boat deck. As anchors are typically heavy objects, this poses a difficulty to boaters as they must hoist the anchor up to the boat deck, then carry it to the anchor storage area, and then place the anchor inside of it. This particularly poses an issue on pleasure-craft such as pontoon boats, which are designed to provide boaters with a fun excursion without being physically demanding. Additionally, such pleasure craft are frequently used by boaters who are elderly or disabled who may be unable to put the anchor back, making such boaters unable to fully enjoy their craft. Further, having the anchor storage area on the boat deck uses storage space that boaters would prefer to use for items such as refreshments, personal floatation devices, or water toys.

Furthermore, as the anchor is wet and muddy when it is lifted up, water and mud drip from the anchor onto the boat deck when it is being carried. This poses an issue to boaters as this dripping water and mud may make the boat deck slippery. This is particularly an issue on pleasure-craft as boaters and their guests may slip on such slippery surfaces. Additionally, the boat decks of pleasure-craft are frequently covered with decorative flooring, such as carpet or wood, which may be damaged by water, mud and/or the anchor itself.

SUMMARY

In accordance with the present invention, a boat anchor storage tray includes an attachment member, and at least one mounting channel attached to the attachment member. In another aspect, a tray is slidably engaged with the at least one mounting channel and is configured to move between an open position and a closed position below a boat deck. A further aspect of a movable boat anchor storage tray includes water draining holes. In yet another aspect, a boat apparatus includes a storage tray moveable from an open position to a closed position below a pontoon boat deck, with a lock movably securing the tray in the closed position.

Advantageously, the boat anchor storage tray can be attached below a boat deck which reduces the height a boater would have to lift the boat anchor compared to storage on the boat deck, and allows for additional space on top of the boat deck. Moreover, the below-deck storage track beneficially is packaged in otherwise unused space between pontoons if employed in a pontoon boat. Additionally, water does not drip onto the boat deck, but instead, the water on the anchor flows down a downwards slope of the closed tray, and through the drain holes and into the body of water the boat is floating upon. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 7A:
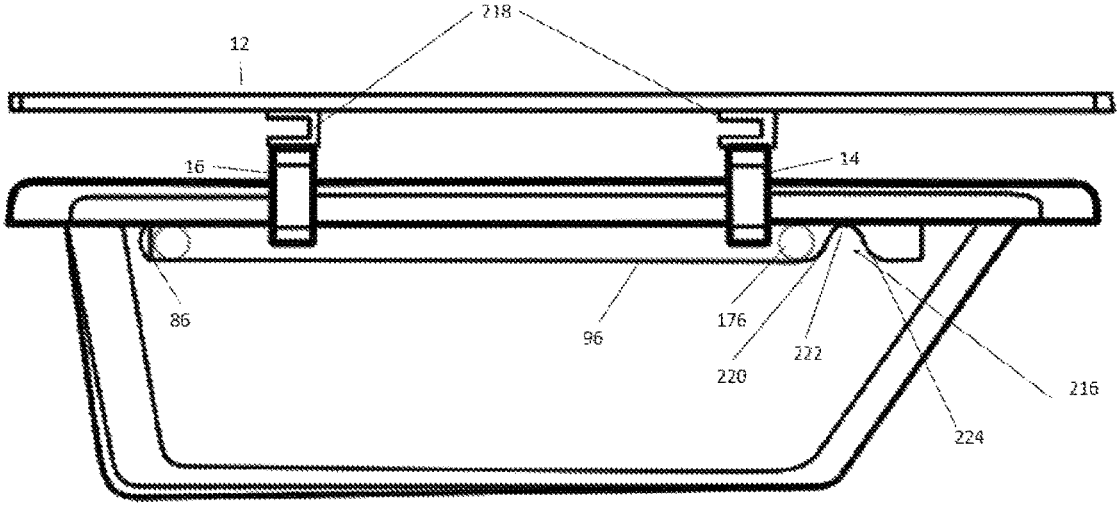

FIG. 7*a* is a side view of the boat anchor storage tray with a lift-and-pull mechanism in the closed position.

Figure 7B:
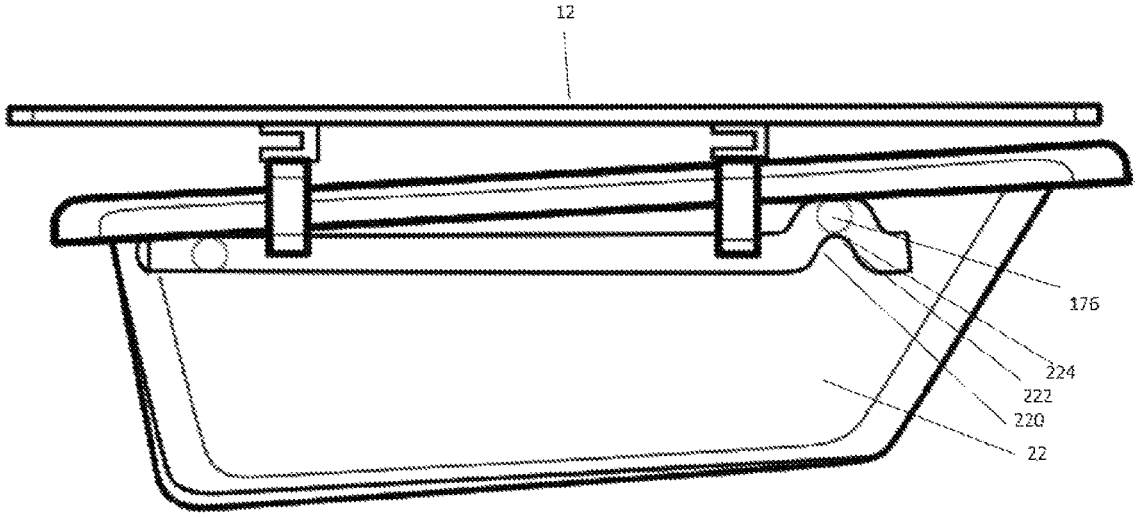

FIG. 7*b* is a side view of the boat anchor storage with a lift-and-pull mechanism tray half-way between the closed position and the open position.

Figure 7C:
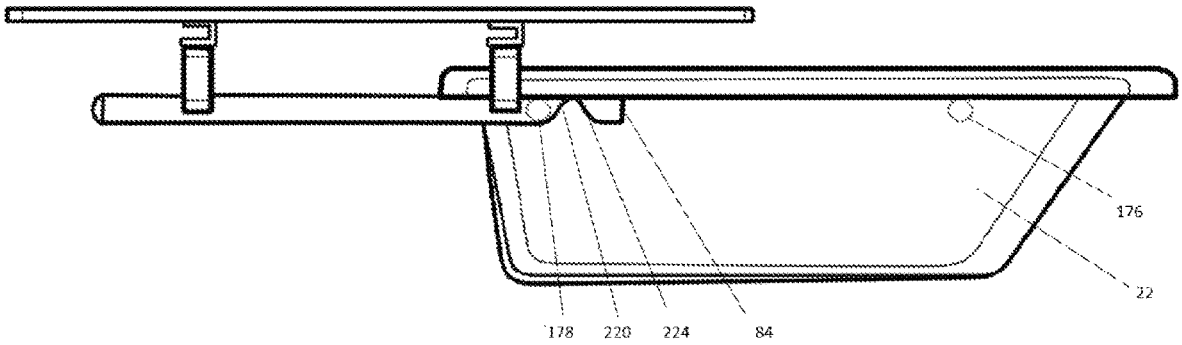

FIG. 7*c* is a side view of the boat anchor storage tray with a lift-and-pull mechanism in the open position.

Figure 8:
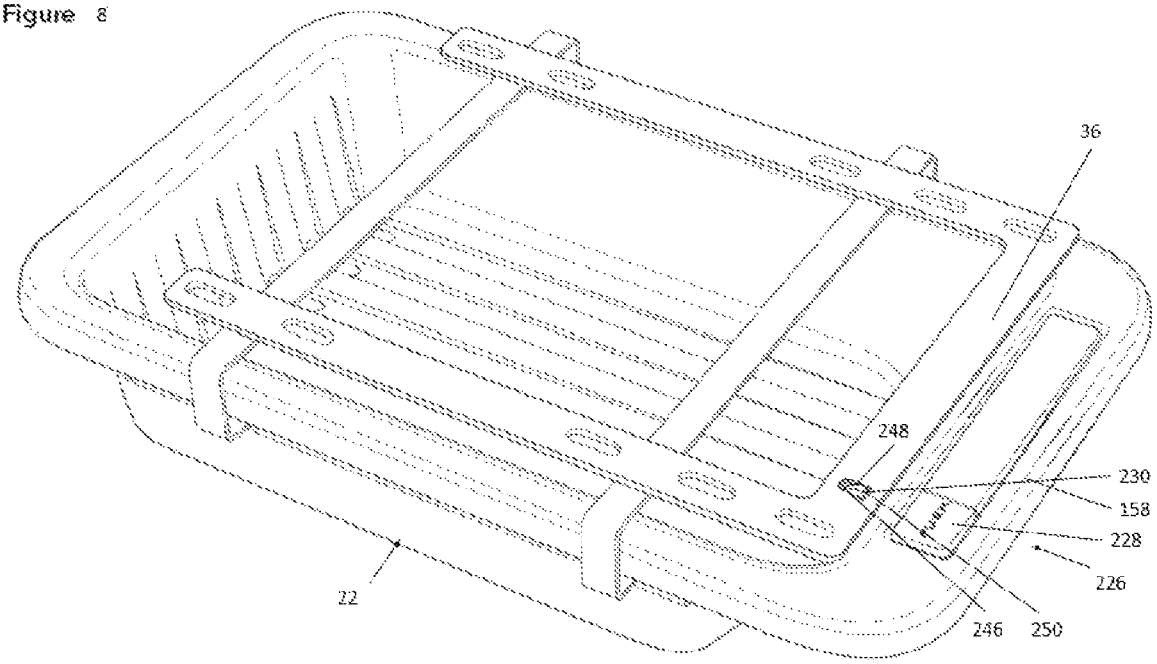

FIG. 8 is a top perspective view of the boat anchor storage tray with a push button latch in the closed position.

Figure 9:
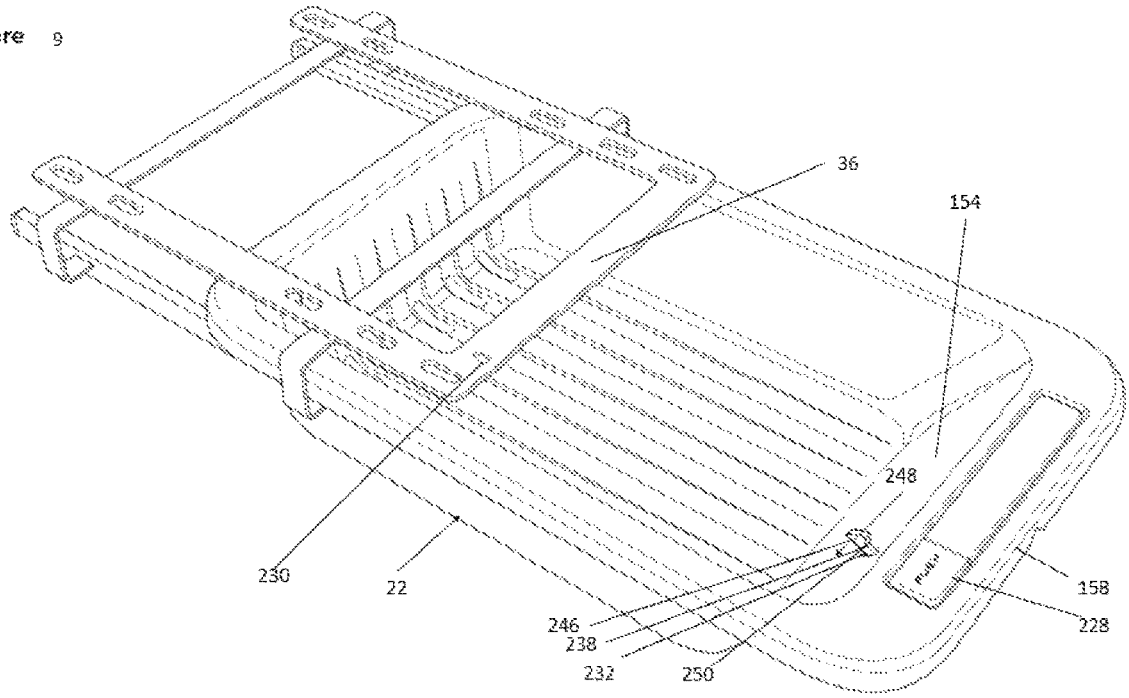

FIG. 9 is a top perspective view of the boat anchor storage tray with a push button latch in the open position.

Figure 10:
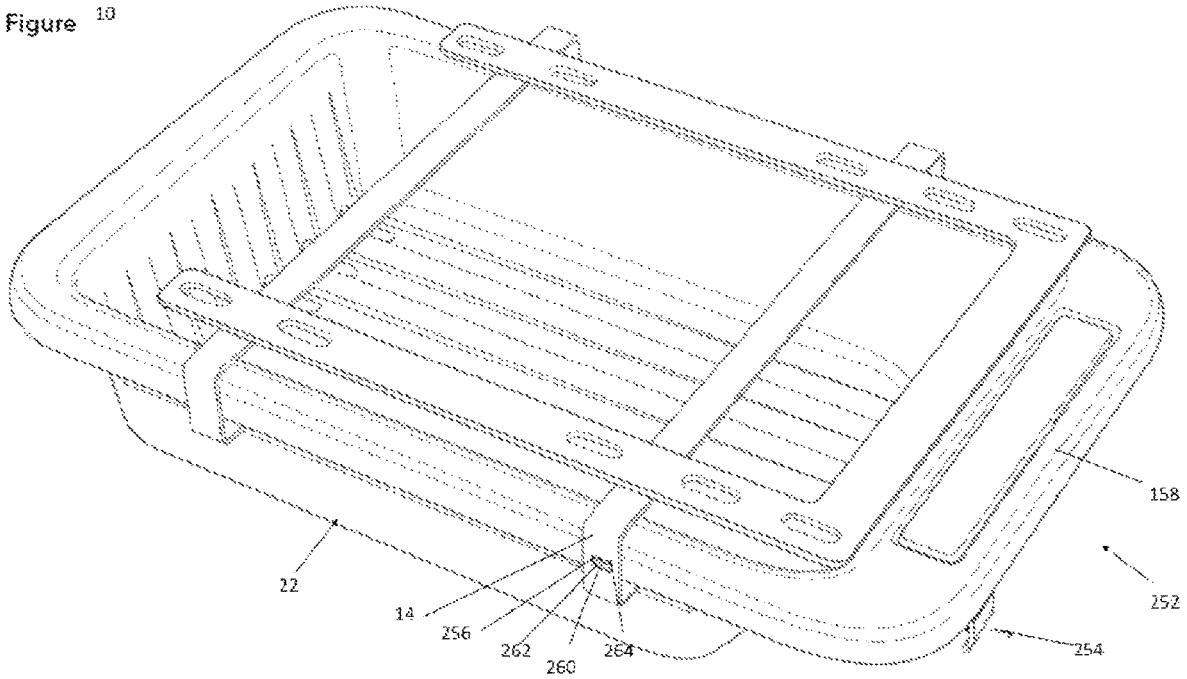

FIG. 10 is a top perspective view of the boat anchor storage tray with a pull tab latch in the closed position.

Figure 11:
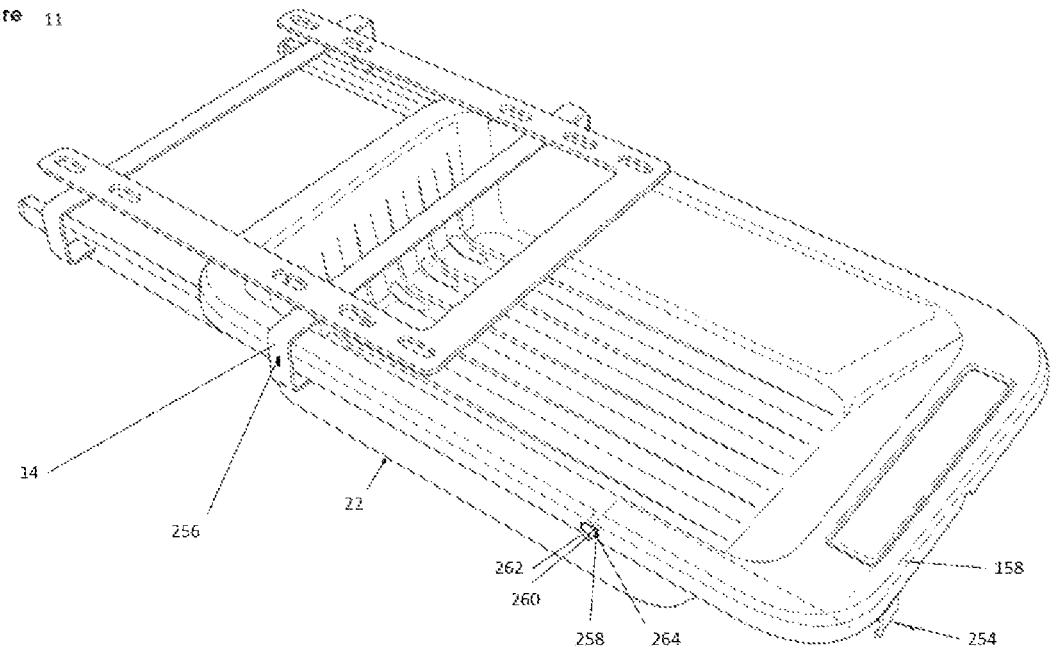

FIG. 11 is a top perspective view of the boat anchor storage tray with a pull tab latch in the open position.

Figure 12:
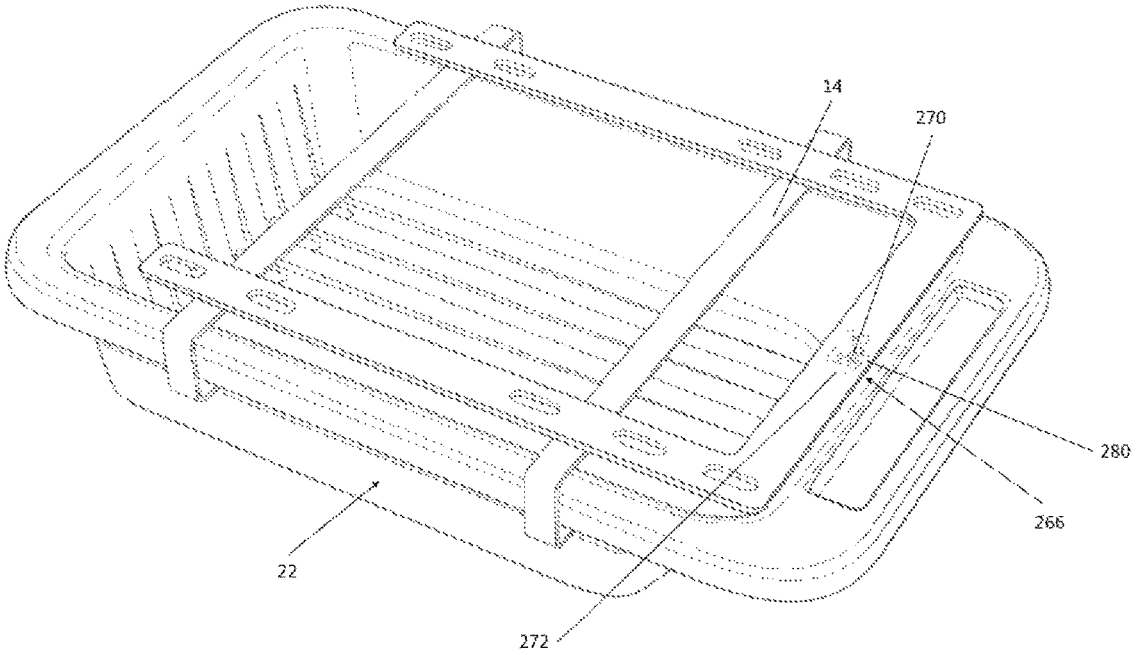

FIG. 12 is a top perspective view of the boat anchor storage tray with a catch locking system in the closed position.

Figure 13:
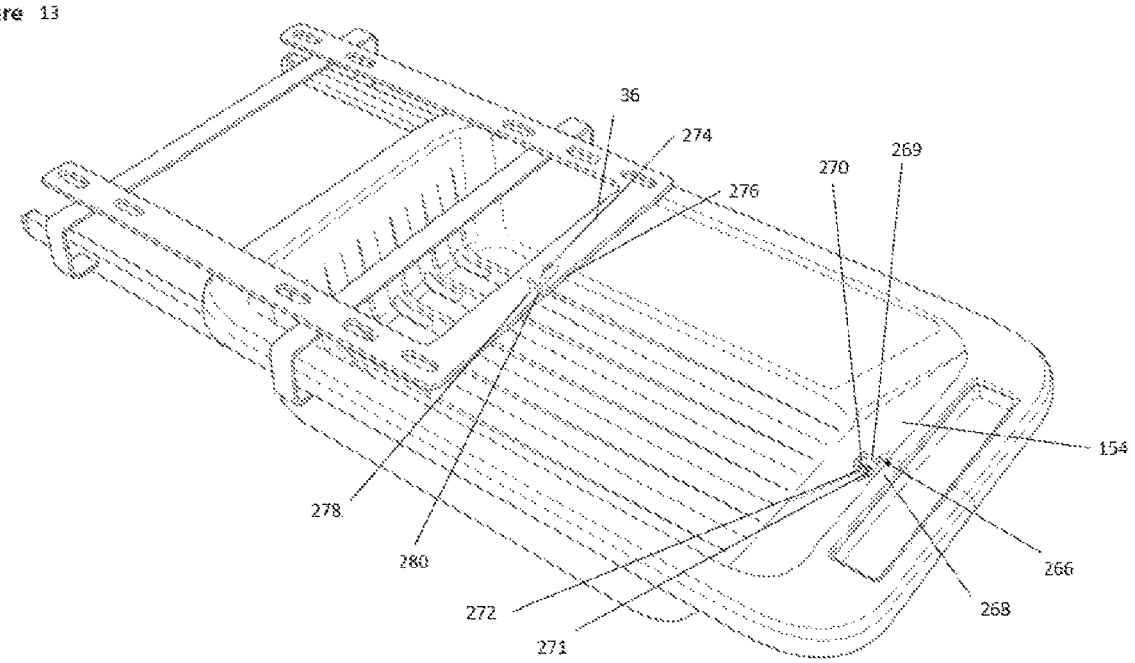

FIG. 13 is a top perspective view of the boat anchor storage tray with a catch locking system in the open position.

Figure 14:
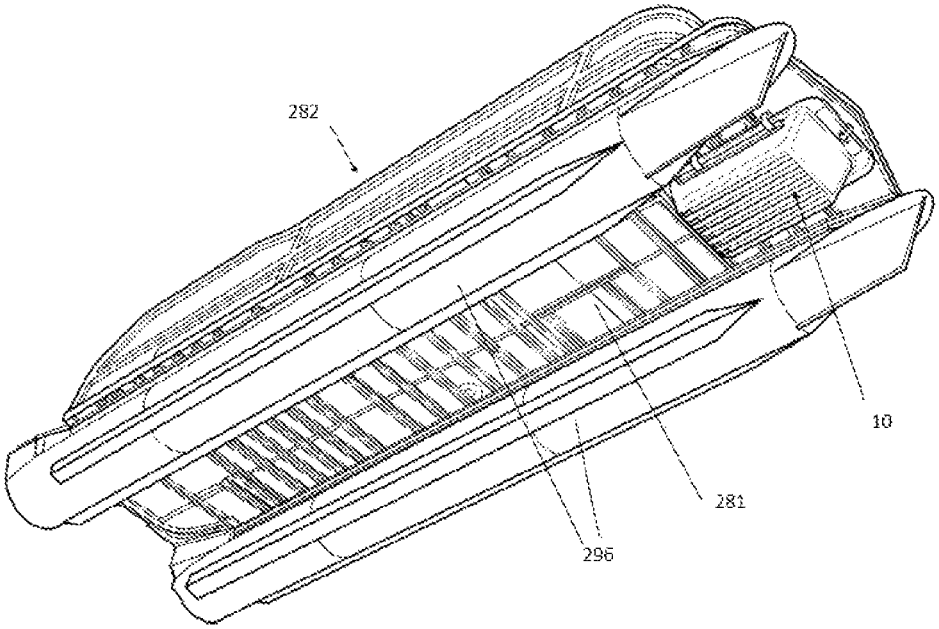

FIG. 14 is a bottom perspective view of a boat with the boat anchor storage tray attached with a rope latch closing system while it is in the closed position.

Figure 15A:
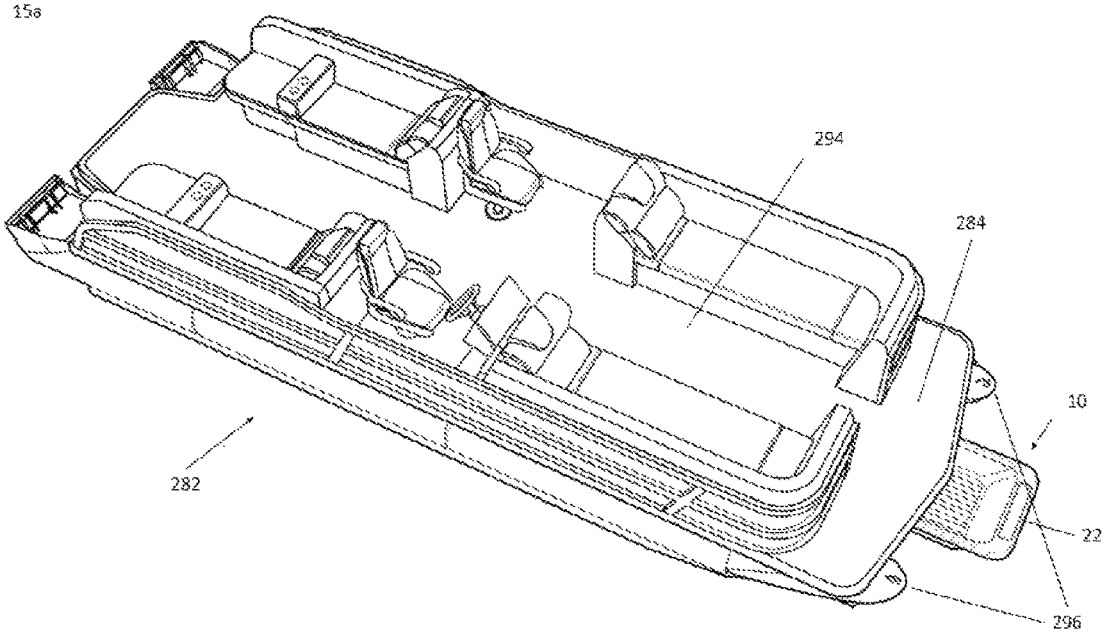

FIG. 15*a* is a top perspective view of the boat with the boat anchor storage tray attached with a rope latch closing system while it is in the open position.

Figure 15B:
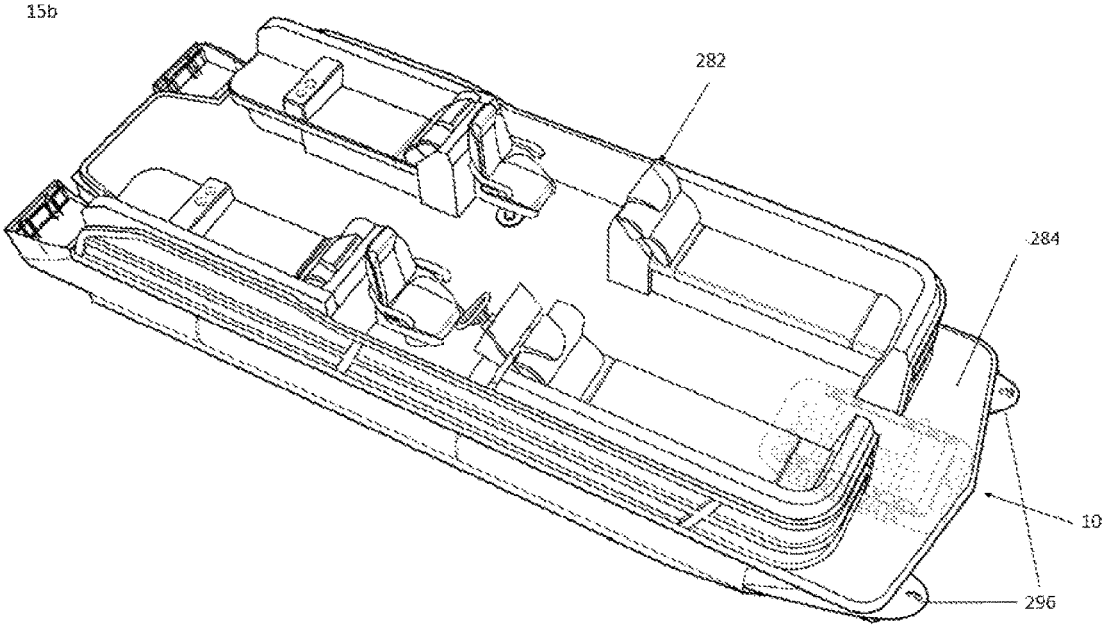

FIG. 15*b* is a top perspective view of the boat with the boat anchor storage tray attached with a rope latch closing system while it is in the closed position.

Figure 16A:
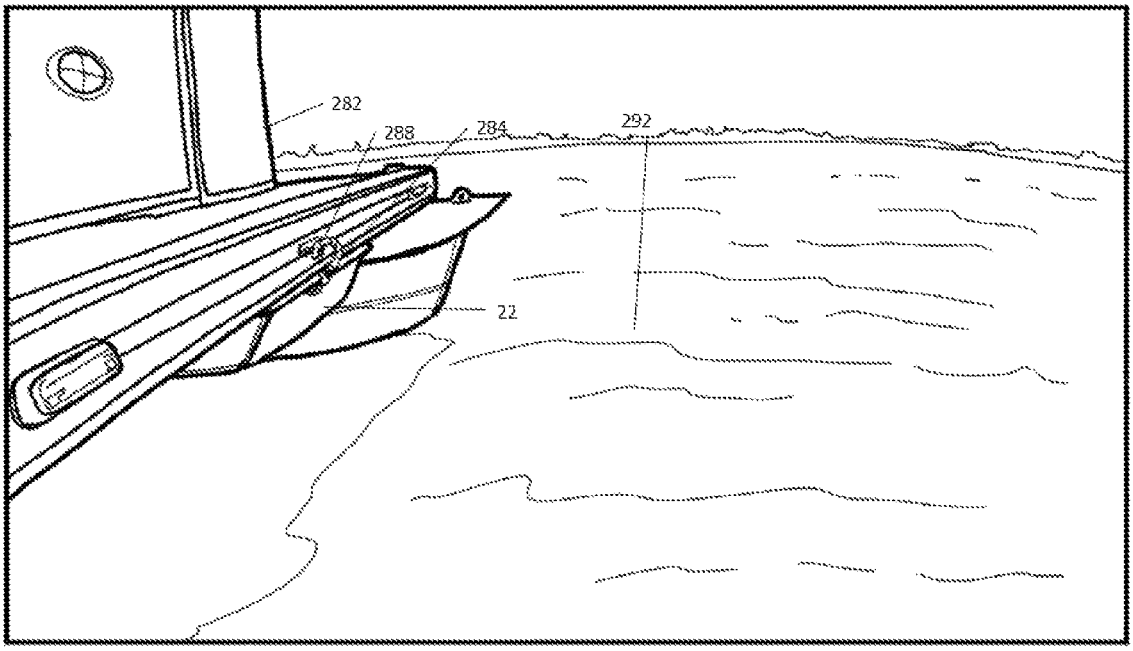

FIG. 16*a* is a stern perspective view of the boat with the boat anchor storage tray attached with the anchor inside the boat anchor storage tray in the closed position.

Figure 16B:
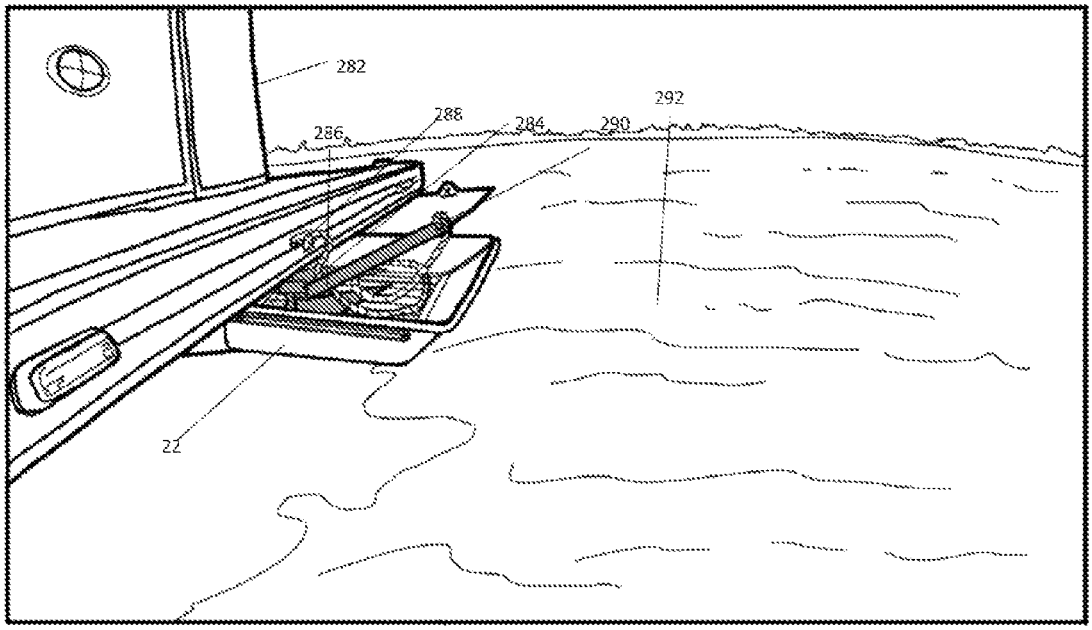

FIG. 16*b* is stern perspective view of the boat with the boat anchor storage tray attached with the anchor inside the boat anchor storage tray in the open position.

Figure 16C:
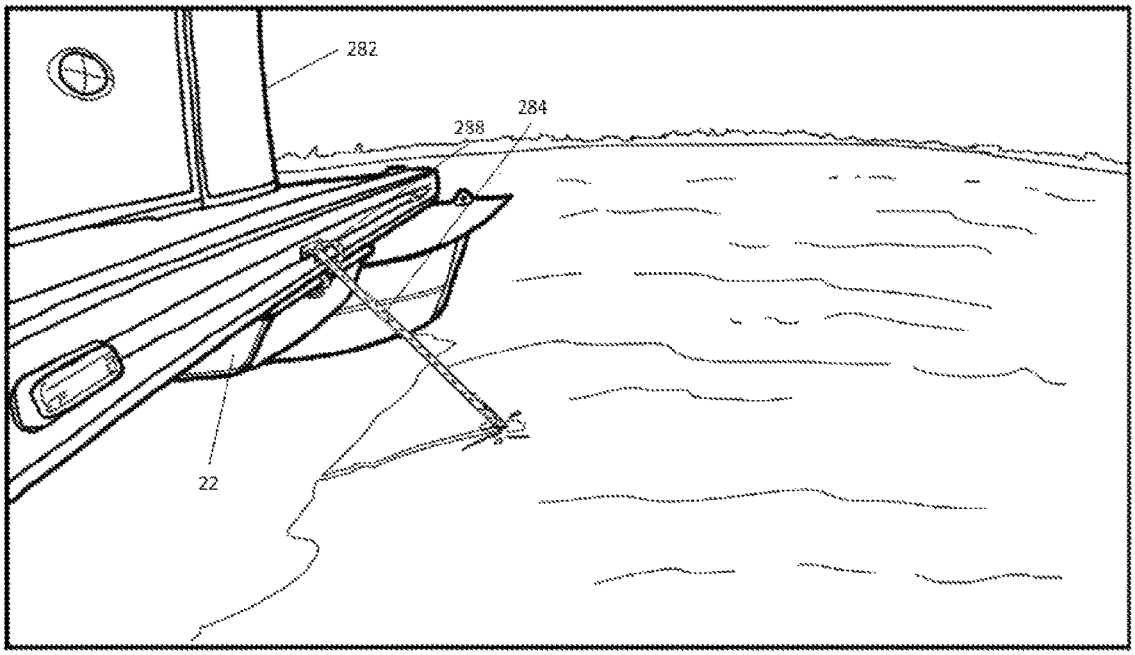

FIG. 16*c* is a stern perspective view of a boat with the boat anchor storage tray attached with the anchor outside the boat anchor storage tray in the closed position.

Corresponding reference numerals indicate corresponding parts throughout the several views of the drawings.

DETAILED DESCRIPTION

With reference to FIGS. 14, 15*a*, and 15*b*, an exemplary boat anchor storage tray 10 is shown attached to a boat 282.

Preferably, boat 282 has a passenger area 294 with a generally flat deck on top of floating pontoons 296. Boat anchor storage tray 10 is attached to boat 282 underneath the passenger area 294, more particularly to a water-facing bottom surface of the deck, in between the floating pontoons 296. In FIG. 15*a*, boat anchor storage tray 10 is in an open position, where the contents of tray 22 are accessible to passengers in the passenger area 294. Boat anchor storage tray 10 can move into a closed position, shown in FIGS. 14 and 15*b*, where boat anchor storage tray 10 is underneath the passenger area 294 and between the floating pontoons 296. The open and closing direction is generally co-axial with a fore-and-aft centerline of the boat.

Figure 1:
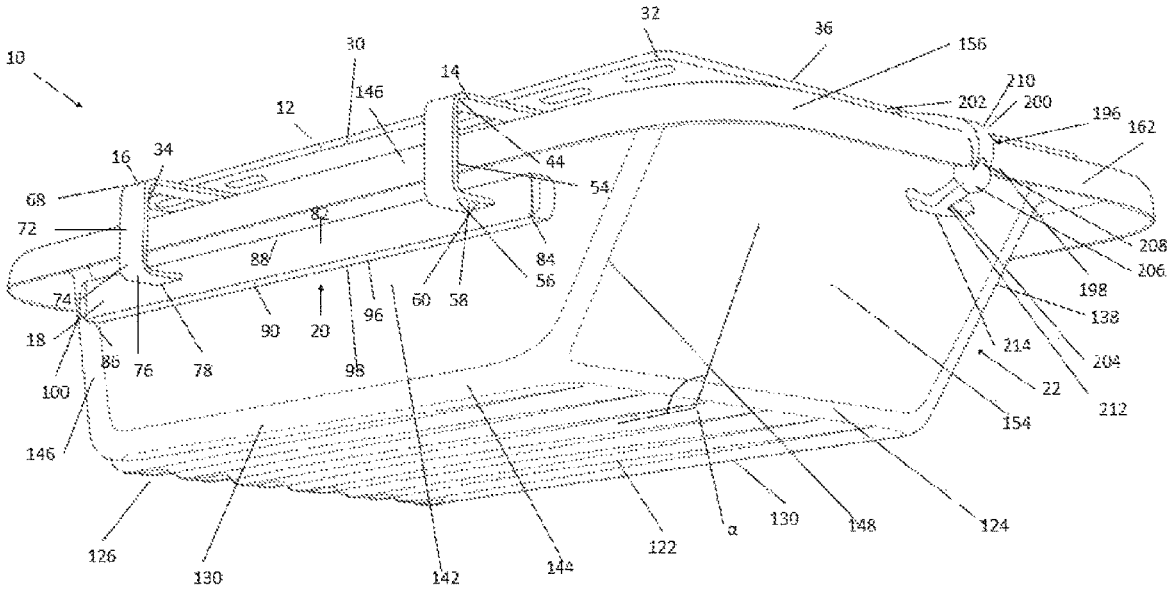
FIG. 1 is a bottom perspective view of a boat anchor storage tray with a rope latch closing system, shown in a closed position.

As shown in FIG. 1, boat anchor storage tray 10 is shown without boat 282. Boat anchor storage tray 10 comprises an attachment member 12, a bow mounting channel 14, a stern mounting channel 16, a port wheel guide 18, a starboard wheel guide 20, and a tray 22.

Figure 2:
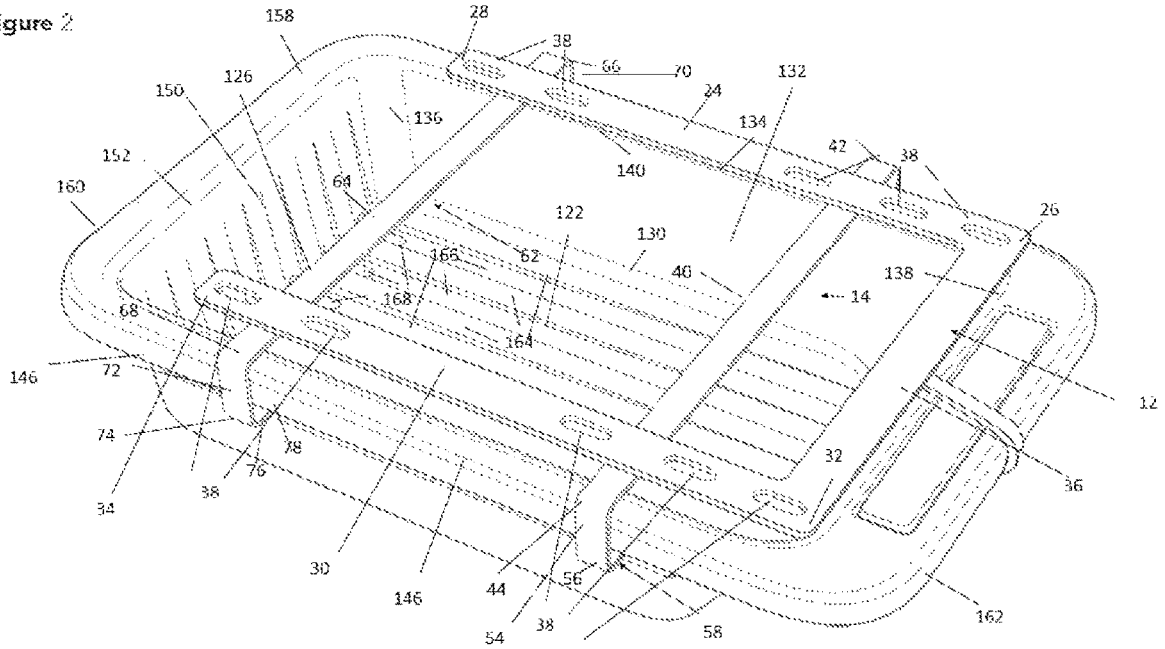
FIG. 2 is a top perspective view of the boat anchor storage tray with the rope latch closing system in the closed position.

As shown in FIG. 2, attachment member 12 comprises a port attachment arm 24 extending from a first port attachment arm end 26 to a second port attachment arm end 28. A starboard attachment arm 30 is disposed parallel to port attachment arm 24 extending from a first starboard attachment arm end 32 to a second starboard attachment arm end 34. A separating arm 36 extends from first port attachment arm end 26 to first starboard attachment arm end 32. A plurality of oblong-shaped apertures 38 are defined by port attachment arm 34 and starboard attachment arm 30 and configured to accept fasteners attaching attachment member 12 to boat 282. Bow mounting channel 14 comprises a bow mounting channel web 40 extending from a first bow mounting channel web end 42 near the port attachment arm 24 to a second bow mounting channel web end 44 near starboard attachment arm 30. Bow mounting channel 14 is disposed parallel to separating arm 36 and attached to the port attachment arm 24 and starboard attachment arm 30 near separating arm 36.

Figure 6:
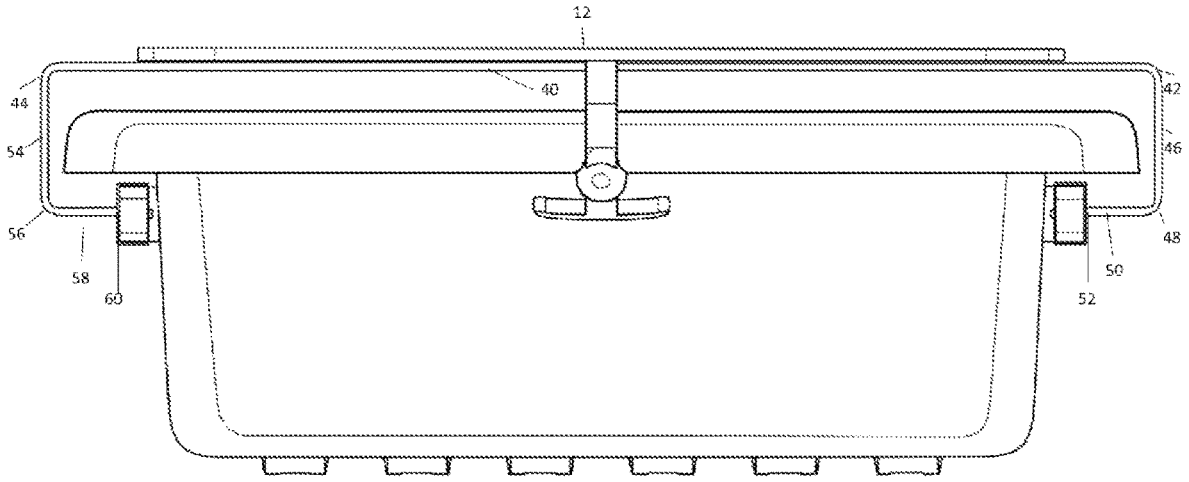
FIG. 6 is a front view of the boat anchor storage tray with a rope latch closing system in the closed position.

As shown in FIGS. 2 and 6, a port bow mounting channel flange 46 extends away from attachment member 12 from first bow mounting channel web end 42 to a second port bow mounting channel flange end 48. A port bow mounting channel lip 50 extends parallel to bow mounting channel web 40 and towards starboard attachment arm 30 from second port bow mounting channel flange end 50 to a second port bow mounting channel lip end 52.

A starboard bow mounting channel flange 54 extends away from attachment member 12 from second bow mounting channel flange end 44 to a second starboard bow mounting channel flange end 56. A starboard bow mounting channel lip 58 extends parallel to bow mounting channel web 40 and towards port attachment arm 24 from second starboard bow mounting channel flange end 56 to a second starboard bow mounting channel lip end 60.

A stern mounting channel 62 comprises a stern mounting channel web 64 which extends from a first stern mounting channel end 66 near port attachment arm 24 to a second stern mounting channel end 68 near starboard attachment arm 30 and attached to port attachment arm 24 and starboard attachment arm 30 near second port attachment arm end 28 and second starboard attachment arm end 34.

A port stern mounting channel flange 70 extends away from attachment member 12 from first stern mounting channel web end 66 to a second port stern mounting channel flange end (not shown). A port stern mounting channel lip (not shown) extends parallel to stern mounting channel web 64 and towards starboard attachment arm 30 from second port stern mounting channel flange end (not shown) to a second port stern mounting channel lip end (not shown).

A starboard stern mounting channel flange 72 extends away from attachment member 12 from second stern mounting channel web end 68 to a second starboard stern mounting channel flange end 74. A starboard stern mounting channel lip 76 extends parallel to starboard stern mounting channel web 64 and towards port attachment arm 24 from second starboard stern mounting channel flange end 74 to a second starboard stern mounting channel lip end 78.

As shown in FIG. 1, a starboard wheel guide 20 comprises starboard wheel guide member 82 extending parallel to starboard attachment arm 30 from a first starboard wheel guide end 84 near first starboard attachment arm end 32 to a second starboard wheel guide end 86 near second starboard attachment arm end 34 and attached to second starboard bow mounting channel lip end 60 and second starboard stern mounting channel lip end 78, also extending parallel to starboard bow mounting channel flange 72 from a first starboard wheel guide edge 88 near attachment member 12 to a second starboard wheel guide edge 90.

Figure 3:
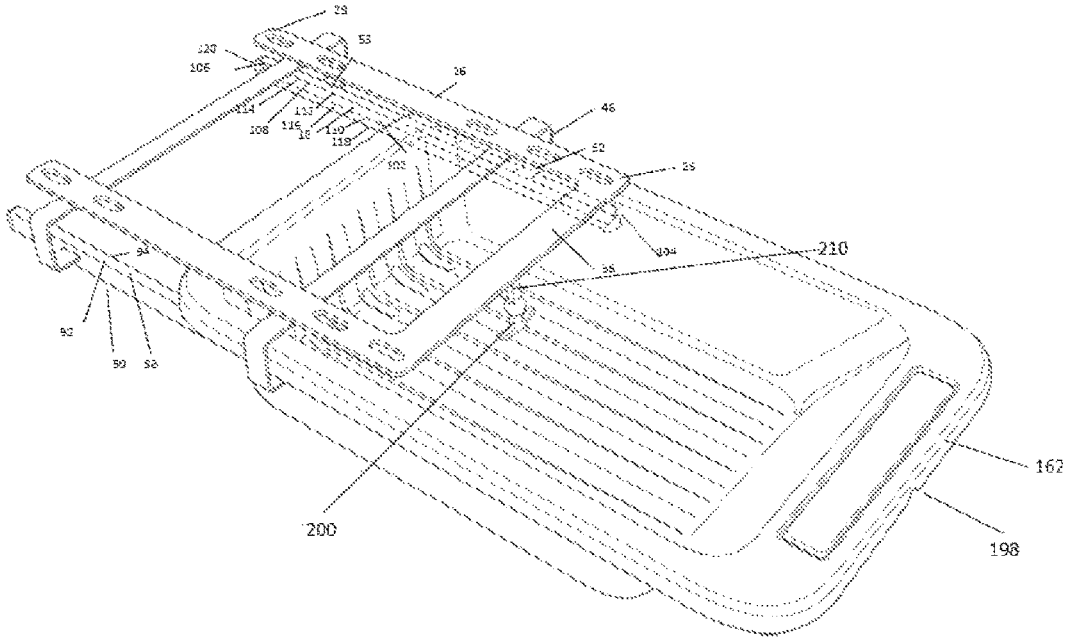
FIG. 3 is a top perspective view of the boat anchor storage tray with the rope latch closing system in an open position.

As shown in FIG. 3, a boat-side starboard wheel guide lip 92 extends parallel to separating arm 36 from first edge of the starboard wheel guide member 88 to a second boat-side starboard wheel guide lip end 94. As shown in FIG. 1, a water-side starboard wheel guide lip 96 extends parallel to separating arm 36 from second starboard wheel guide member edge 90 to a second water-side starboard wheel guide lip end 98. A starboard wheel guide stop 100 is attached to the second starboard wheel guide end 86.

As shown in FIG. 1, a port wheel guide 18 comprises a port wheel guide member 102 extending from a first port wheel guide end 104 near first port attachment arm end 26 to a second port wheel guide member end 106 near second port attachment arm end 28 and attached to second port bow mounting channel lip end 52 and second port stern mounting channel lip end 53, also extending parallel to the port mounting channel flange 46 from a first port wheel guide edge 108 near the attachment member 12 to a second port wheel guide edge 110. A boat-side port wheel guide lip 112 extends parallel to separating arm 36 from first port wheel guide edge 108 to a second boat-side port wheel guide lip end 114. A water-side port wheel guide lip 116 extends parallel to separating arm 36 from second port wheel guide edge 110 to a second bottom port wheel guide lip end 118. A port wheel guide stop 120 is attached to the second port wheel guide end 106.

As shown in FIG. 1, a tray 22 is provided. Tray 22 comprises a base 122 with a bow base end 124, a stern base end 126 opposite bow base end 124, a starboard base end 128 between stern base end 126 and bow base end 124 and a port base end 130 opposite starboard base end 128. A starboard tray wall 142 extends from base 122 between starboard base end 144 and a tray wall starboard edge 146, starboard tray wall 142 having a starboard tray wall stern edge 146, and a starboard tray wall bow edge 148. A bow tray wall 154 extends such that an angle $\alpha$ between base 122 and bow tray wall 154 exceeds ninety degrees, and extends from base bow end 124 to a bow tray wall rim edge 156, and extending from port tray wall bow edge 138 to starboard tray wall bow edge 148.

As shown in FIG. 2, a port tray wall 132 extends from base 122 between port base end 130 and a tray wall port edge 134, port tray wall 132 has a port tray wall stern edge 136, and a port tray wall bow edge 138. A stern tray wall 150 extends from base 122 from stern base end 126 to a stern tray rim edge 152, and extends from starboard tray wall stern edge 146 to port tray wall stern edge 136.

A tray rim 158 extends annularly from tray wall bow edge 138, tray wall port edge 134, tray wall starboard edge 146, and tray wall stern edge 136 to a tray rim edge 160. A tray lip 162 extends from tray rim edge 160 towards base 122. Base 122 and stern tray wall 150 comprise a plurality of ridges 164 abutting lowered sections 166. A plurality of drains 168 are defined by lowered sections 166. In the direction from bow tray wall 154 to plurality of drains 168, lowered sections 166 comprise a downward slope towards plurality of drains 168, such that fluid in tray 22 passively flows from base 122 into plurality of drains 168.

Figure 4:
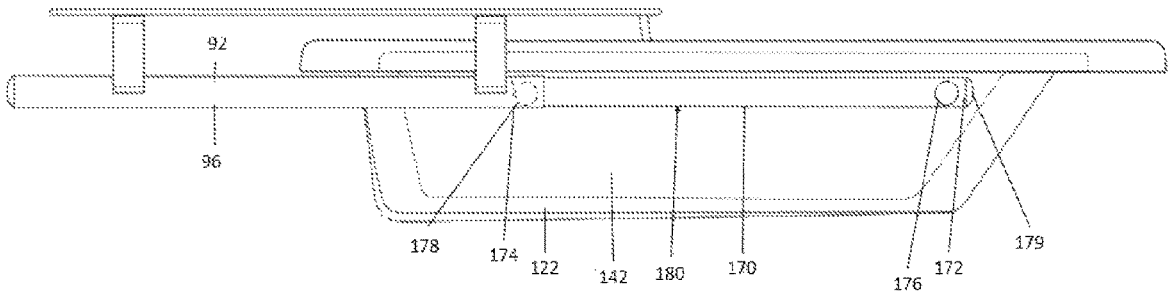
FIG. 4 is a starboard side view of the boat anchor storage tray in the open position.

As shown in FIG. 4, a sliding mechanism attaches tray 22 to bow mounting channel 14 and stern mounting channel 16. A starboard wheel bar 180 includes a starboard wheel member 170 attached to starboard tray wall 142 extending parallel to base 122 from a starboard wheel member bow end 172 to a starboard wheel member stern end 174. A starboard bow wheel 176 is attached to starboard wheel member 170 near starboard wheel member bow end 172, and a starboard stern wheel 178 is attached to starboard wheel member 170 near starboard wheel member stern end 174. A starboard wheel bar stop 179 is attached to starboard wheel bar bow end 172. Starboard bow wheel 176 and starboard stern wheel 178 are configured to be inserted between boat-side starboard wheel guide lip 92 and water-side starboard wheel guide lip 96 such that starboard wheel bar 180 is slidably engaged with starboard wheel guide 20.

Figure 5:
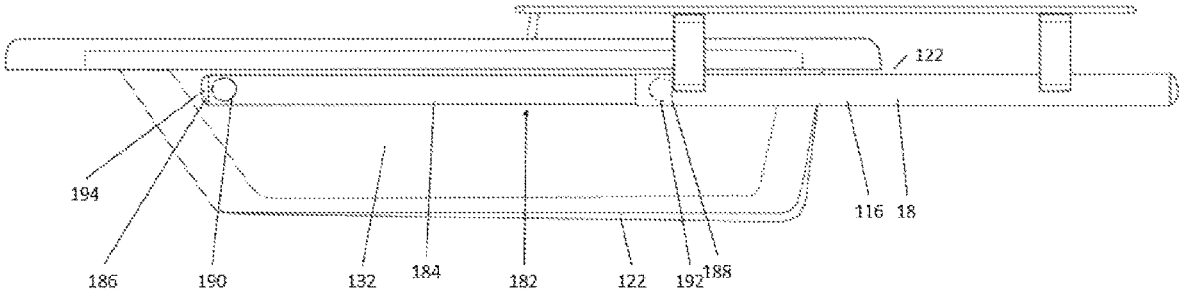
FIG. 5 is a port side view of the boat anchor storage tray in the open position.

As shown in FIG. 5, a port wheel bar 182 includes a port wheel member 184 attached to port tray wall 132 extending parallel to base 122 from a port wheel member bow end 186 to a port wheel member stern end 188. A port bow wheel 190 is attached to port wheel member 184 near port wheel member bow end 186, and a port stern wheel 192 is attached to port wheel member 184 near port wheel member stern end 188. A port wheel bar stop 194 is attached to port wheel bar bow end 186. Port bow wheel 190 and port stern wheel 192 are configured to be inserted between boat-side port wheel guide lip 122 and water-side port wheel guide lip 116 such that port wheel bar 182 is slidably engaged with port wheel guide 18.

As shown in FIG. 1, boat anchor storage tray 10 may include a closing system comprising a rope latch system 196. In this embodiment, an indent 198 is defined in tray lip 162 near bow tray wall 154. A tether 200 with an attachment end 202 and a handle end 204, is attached to separating arm 36 at attachment end 202. A ball 206 defining a slot 208 is provided with tether 200 inserted inside slot 208. Ball 206 separates tether 200 into an attachment section 210 between ball 206 and attachment end 204, and a handle section 212 between ball 206 and handle end 204. A handle 214 is attached to attachment end 204 of tether 200. Handle 214 is T-shaped in order to provide an easy grip on handle 214. When tray 22 is in the closed position, attachment section 210 of tether 200 is inserted into indent 198, and held in place by ball 206 which abuts tray lip 162. Tray 22 is placed in the open position by gripping handle 214 and pulling tether 200 such that attachment section 210 is no longer in indent 198, and then sliding tray 22 into the open position.

As shown in FIG. 3, when tray 22 is in the open position, tether 200 dangles freely from separating arm 36. Tray 22 is placed in the closed position by sliding tray 22 until tether 200 can be placed over tray lip 162, and attachment section 210 is placed in indent 198.

As shown in FIG. 7*a*, the closing system may comprise a lift-and-pull mechanism 216. Lift-and-pull mechanism 216 includes spacers 218 installed between attachment member 12 and bow mounting channel 14 and stern mounting channel 16 which provide a space for tray 22 to be lifted. Up-ramps 220 are provided in water-side starboard wheel guide lip 96 and water-side port wheel guide lip 116. Up-ramps 220 each abut a crest 222, which then abuts down-ramps 224. In the closed position, starboard bow wheel 176 is on the second starboard wheel guide end 86 side of up-ramps 220, and port bow wheel 190 is on the second port wheel guide end 106 of up-ramps 220.

As shown in FIG. 7*b*, when converting tray 22 into the open position, tray 22 is lifted up up-ramps 220 towards attachment member 12 and pulled such that starboard bow wheel 176 and port bow wheel 190 lay on crest 222. Tray 22 is then pulled down down-ramps 224 and is continued to be pulled until tray 22 is in the open position.

As shown in FIG. 7*c*, when tray 22 is in the open position, starboard bow wheel 176 and port bow wheel 190 go down down-ramps 224 and continue past first starboard wheel guide end 84 and first port wheel guide end 104. Starboard stern wheel 178 is on the second starboard wheel guide end 86 of up-ramps 220, and port stern wheel 192 is on the second port wheel guide end 106 of up-ramps 220.

As shown in FIGS. 8 and 9, the closing system may comprise a push button latch 226. A push button 228 is located on tray rim 158, a latch hook hole 230 is defined by separating arm 36, and a wall latch arm hole 232 is defined by bow tray wall 154. A latch lever 234 extends from a first latch lever end (not shown) attached to push button 228, to a second latch lever end 238. A latch hook 246 is attached to second latch lever end 238. Latch hook 246 comprises a triangular profile with a closing surface 248 and a locking surface 250, closing surface 248 is rounded and locking surface 250 is steep.

As shown in FIG. 8, when tray 22 is in the closed position, latch hook 246 is inserted inside latch hook hole 230, with locking surface 250 in contact with separating arm 36, thereby preventing tray 22 from being converted into the open position. A spring is provided to hold latch hook 245 inside latch hook hole 230 unless push button 228 is pressed or a force is imparted on closing surface 248. To convert tray 22 to the open position, push button 228 is pressed, removing latch hook 246 from latch hook hole 230. Locking surface 250 is thereby no longer in contact with separating arm 36 and tray 22 is capable of being pulled into the open position.

As shown in FIG. 9, tray 22 can be converted from the open position to the closed position by pushing tray 22 towards separating arm 36 until closing surface 248 abuts separating arm 36. Separating arm 36 then imparts a force on closing surface 248 which lowers latch hook 246 until it lays below latch hook hole 230. When latch hook 246 is below latch hook hole 230, separating arm 36 is no longer in contact with closing surface 248, and the spring pushes latch hook 246 into latch hook hole 230 such that locking surface 250 abuts separating arm 36.

As shown in FIGS. 10 and 11, the closing system may comprise a pull-tab latch 252. A pull tab 254 is located on tray rim 158 and a bow mounting channel latch hook hole 256 is defined by bow mounting channel 14. A rim latch hook hole 258 is defined by tray rim 158, and a rim latch hook 260 is inserted inside rim latch hook hole 258. Rim latch hook 260 comprises a triangular profile with a rim latch closing surface 262 and a rim latch locking surface 264. A rim latch lever system is provided which connects pull tab 254 to rim latch hook 260 such that when pull tab 254 is pulled, rim latch hook locking surface 264 is inside rim latch hook hole 258. A spring is provided to impart a force keeping rim latch locking surface 264 outside of rim latch hook hole 258 unless pull tab 254 is pulled or a pressure is imparted on rim latch closing surface 262.

As shown in FIG. 10, rim latch hook 260 is in bow mounting channel latch hook hole 256 when tray 22 is in the closed position. In this position, rim latch locking surface 264 is in contact with bow mounting channel 14, thereby preventing tray 22 from being pulled into the open position. To convert tray 22 into the open position, pull tab 254 is pulled, thereby causing rim latch locking surface 264 to be inside rim latch hook hole 258. Rim latch locking surface 264 therefore no longer prevents tray 22 from being put in the open position.

As shown in FIG. 11, when tray 22 is in the open position, rim latch closing surface 262 is outside of rim latch hook hole 258 and faces bow mounting channel 14. When tray 22 is pushed towards the closed position, rim latch closing surface 262 contacts bow mounting channel 14. As tray 22 is continued to be pushed into the closed position, bow mounting channel 14 imparts a force on rim latch closing surface 262, pushing rim latch hook 260 inside rim latch hook hole 258. As tray 22 continues to be pushed into the closed position, rim latch closing surface 262 reaches bow mounting channel latch hook hole 256. Bow mounting channel 14 then ceases to impart a force on rim latch closing surface 262, and the spring pushes rim latch hook 260 into bow mounting channel latch hook hole 256, with rim latch locking surface 264 abutting bow mounting channel 14.

As shown in FIGS. 12 and 13, the closing system may comprise a catch plate system 266. A catch plate 268 is attached to bow tray wall 154. Catch plate 268 includes an upper catch plate arm 269 extending from catch plate 268 to an upper catch plate roller 270, and a lower catch plate arm 271 extending from catch plate 268 to a lower catch plate roller 272. A locking bar plate 274 is attached to separating arm 36, and includes a first locking bar leg 276 extending toward tray 22, a second locking bar leg 278 extending towards tray 22, and a locking bar 280 extending from first locking bar leg 276 to second locking bar leg 278. A spring is provided causing upper catch plate roller 270 and lower catch plate roller 272 to abut each other unless a force is applied by locking bar 280.

As shown in FIG. 12, when tray 22 is in the closed position, upper catch plate roller 270 and lower catch plate roller 272 abut each other between locking bar 280 and bow mounting channel 14. When tray 22 is pulled towards the open position, locking bar 280 imparts a force on upper catch plate roller 270 and lower catch plate roller 272. This force causes upper catch plate roller 270 and lower catch plate roller 272 to no longer abut, allowing locking bar 280 to slide through upper catch plate roller 270 and lower catch plate roller 272. Tray 22 is then able to be pulled into the open position without resistance from locking bar 280 on upper catch plate roller 270 and lower catch plate roller 272.

As shown in FIG. 13, when tray 22 is in the open position, upper catch plate roller 270 and lower catch plate roller 272 abut each other outside of the area between bow mounting channel 14 and locking bar 280. When tray 22 is pushed towards the closed position, upper catch plate roller 270 and lower catch plate roller 272 contact locking bar 280. Locking bar 280 then imparts a force separating upper catch plate roller 270 and lower catch plate roller 272, allowing locking bar 280 to slide between upper catch plate roller 270 and lower catch plate roller 272. As tray 22 is put into the closed position, locking bar 280 no longer contacts upper catch plate roller 270 and lower catch plate roller 272, and upper catch plate roller 270 and lower catch plate roller 272 abut each other between bow mounting channel 14 and locking bar 280.

As shown in FIGS. 16*a*, 16*b*, and 16*c*, an anchor 286 may be stored within tray 22. An anchor attachment point 288 is attached to boat 282, and a rope or chain anchor line 284 extends from anchor attachment point 288 to a second anchor line end 290 attached to anchor 286. As shown in FIG. 16*a*, before preparing to anchor boat 282, tray 22 is in the closed position. As shown in FIG. 16*b*, before anchoring boat 282, tray 22 is moved into the open position, anchor 286 is removed from tray 22, and lowered into a body of water 292. Tray 22 can then be placed back into the closed position as shown in FIG. 16*c*.

While various embodiments of the present invention have been disclosed, it should also be appreciated that other variations may be employed. For instance, boat anchor storage tray may be placed such that it is on the starboard or port side of the boat. However, advantages such as ease of access and utilization of unused space will not be achieved. It is alternatively envisioned that the tray may be slidably engaged with the mounting channels without wheels, such as with a scissor mechanism, although some of the preferred advantages may not be realized, such as ease of use. It should also be appreciated that any of the preceding embodiments and features thereof can be mixed and matched with any of the others in any combination depending upon the final product and processing characteristics desired. Variations are not to be regarded as a departure from the present disclosure, and all such modifications are intended to be included within the scope and spirit of the present invention.

The invention claimed is:

1. A boat anchor storage apparatus comprising:

an attachment member;

at least one mounting channel coupled to the attachment member;

at least one wheel guide coupled to the at least one mounting channel;

a boat-mounted storage tray slidably engaged with the at least one mounting channel comprising a base and configured to slide between an open position and a closed position;

drains located in the boat-mounted storage tray;

the base comprising a downward slope towards the drains; and the base being configured to induce a flow of fluid in the base down the downward slope, and into the drains.

2. The boat anchor storage apparatus of claim 1, further comprising a plurality of ridges in the base abutting a plurality of lowered sections, and the attachment member including an elongated arm having apertures therein.

3. The boat anchor storage apparatus of claim 1, wherein the attachment member comprises:

a port attachment arm extending from a first port attachment arm end to a second port attachment arm end;

a starboard attachment arm disposed parallel to the port attachment arm extending from a first starboard attachment arm end to a second starboard attachment arm end;

a separating arm extending from the first port attachment arm end to the first starboard attachment arm end; and a plurality of oblong-shaped apertures defined by the port attachment arm and the starboard attachment arm configured to accept fasteners attaching the attachment member to a boat.

4. The boat anchor storage apparatus of claim 1, wherein the at least one mounting channel comprises a bow mounting channel and a stern mounting channel.

5. The boat anchor storage apparatus of claim 4, wherein the bow mounting channel comprises:

a bow mounting channel web extending from a first bow mounting channel web end to a second bow mounting channel web end;

a port bow mounting channel flange extending from the first bow mounting channel web end to a second bow mounting channel flange end;

a port bow mounting channel lip extending parallel to the bow mounting channel web and from a first port bow mounting channel lip end attached to the second bow mounting channel flange end to a second port bow mounting channel lip end;

a starboard bow mounting channel flange extending from a first starboard bow mounting channel flange end attached to the second bow mounting channel flange end to a second starboard bow mounting channel flange end; and a starboard bow mounting channel lip extending parallel to bow mounting channel web and from a first starboard bow mounting channel lip end attached to the second starboard bow mounting channel flange end to a second starboard bow mounting channel lip end.

6. The boat anchor storage apparatus of claim 4, wherein the stern mounting channel comprises:

a stern mounting channel web extending from a first stern mounting channel web end to a second stern mounting channel web end;

a port stern mounting channel flange extending away from the attachment member from a first port stern mounting channel flange end attached to the first stern mounting channel web end to a second port stern mounting channel flange end;

a port stern mounting channel lip extending parallel to the stern mounting channel web from a first port stern mounting channel lip end attached to the second port stern mounting channel flange end to a second port stern mounting channel lip end;

a starboard stern mounting channel flange extending from a first starboard stern mounting channel flange end attached to the second stern mounting channel web end to a second starboard stern mounting channel flange end; and a starboard stern mounting channel lip extending parallel to the stern mounting channel web from a first starboard stern mounting channel lip end attached to the second starboard stern mounting channel flange end to a second starboard stern mounting channel lip end.

7. The boat anchor storage apparatus of claim 1, wherein the tray comprises a bow tray wall extending such that the angle between the base and the bow tray wall exceeds ninety degrees.

8. The boat anchor storage apparatus of claim 1, further comprising:

a pontoon boat comprising a deck having substantially flat upper and lower surfaces spanning between pontoons, the tray being movably coupled to the lower surface of the deck;

an anchor operably stowed in the boat-mounted storage tray;

a rope or chain having a first end secured to the anchor and having an opposite second end coupled to the pontoon boat at or above the upper surface of the deck; and a lock including a section coupled to the boat-mounted storage tray.

9. The boat anchor storage apparatus of claim 8, further comprising a tray lock comprising:

an indent in the boat-mounted storage tray;

a tether with an attachment end and a handle end, the attachment end attached to the attachment member;

a ball defining a slot configured to have the tether inserted inside of it;

the ball separating the tether into an attachment section between the ball and the attachment end, and a handle section between the ball and the handle end;

a handle attached to the attachment end of the tether; and the boat-mounted storage tray being held in the closed position by the attachment section being placed in the indent.

10. The boat anchor storage apparatus of claim 8, further comprising:

a plurality of spacers installed between the attachment member and the at least one mounting channel;

up-ramps in the at least one wheel guide; and down-ramps in the at least one wheel guide.

11. The boat anchor storage apparatus of claim 8, further comprising a tray lock comprising:

a push button located on the boat-mounted storage tray;

a latch hook hole defined by the attachment member;

a wall latch arm hole defined by the boat-mounted storage tray;

a latch lever extending from the push button to a second latch lever end; and a latch hook attached to second latch lever end, the latch hook comprising a triangular profile with a closing surface and a locking surface, the closing surface being rounded and the locking surface being steep, the latch hook being inserted inside the latch hook hole when the boat-mounted storage tray is in the closed position with the locking surface in contact with the attachment member.

12. The boat anchor storage apparatus of claim 8, further comprising a tray lock comprising:

a pull tab located on the boat-mounted storage tray;

a bow mounting channel latch hook hole defined by the at least one mounting channel, a rim latch hook hole defined by the boat-mounted storage tray;

a rim latch hook inserted inside the rim latch hook hole, the rim latch hook comprising a triangular profile with a rim latch closing surface and a rim latch locking surface;

a rim latch lever system connecting the pull tab to the rim latch hook; and the rim latch hook is in the bow mounting channel latch hook hole when the boat-mounted storage tray is in the closed position.

13. The boat anchor storage apparatus of claim 8, further comprising a catch lock configured to secure the boat-mounted storage tray in the closed position.

14. A boat anchor storage apparatus comprising:

a boat comprising a passenger area;

an anchor attachment point attached to the boat;

an anchor line extending from a first anchor line end attached to the anchor attachment point to a second anchor line end;

an anchor attached to the second anchor line end;

an attachment member attached to the boat beneath the anchor attachment point;

mounting channels attached to the attachment member;

a port wheel guide and a starboard wheel guide attached to the mounting channels;

a tray slidably engaged with the mounting channels comprising a base and configured to move between an open position and a closed position and configured to receive an anchor;

a port wheel bar and a starboard wheel bar attached to the tray; and the port wheel bar and the starboard wheel bar configured to slidably engage with the port wheel guide and the starboard wheel guide.

15. The boat anchor storage apparatus of claim 14 further comprising apertures in the attachment member, wherein the apertures are configured to accept fasteners which attach the attachment member to the boat.

16. The boat anchor storage apparatus of claim 14, further comprising floating pontoons attached the boat under the passenger area.

17. The boat anchor storage apparatus of claim 16, wherein the attachment member is attached to an underside deck surface of the boat between the floating pontoons.

18. The boat anchor storage apparatus of claim 14, further comprising a lock movably securing the tray in the closed position, the passenger area comprising a substantially flat deck, and the anchor attachment point is located at or above the deck.

19. A boat anchor storage apparatus comprising:

a boat comprising a deck including a substantially flat water-facing bottom surface spanning over pontoons;

an anchor attachment point attached to the boat at or above the deck;

a storage tray comprising a base and being configured to receive an anchor;

the storage tray being coupled to the bottom surface of the deck and being configured to slide between an open position and a closed position, the open position extending outboard of the deck and being manually accessible to a user from the deck;

a drain located in the storage tray; and a lock movably securing the storage tray in the closed position.

20. The boat anchor storage apparatus of claim 19, further comprising an anchor line attached to the anchor attachment point.

21. The boat anchor storage apparatus of claim 20, further comprising an anchor attached to the anchor line, and the anchor being manually insertable into the tray and stowed in the storage tray below the deck.

22. The boat anchor storage apparatus of claim 21, further comprising a plurality of ridges in the storage tray, the drain includes multiple spaced apart apertures in a bottom of the storage tray, and the storage tray comprises upstanding walls on all sides thereof with the leading wall having a more diagonal angle than other of the storage tray walls.

* * * * *